United States Patent [19]

Egenolf et al.

[11] 3,958,924

[45] May 25, 1976

[54] FURNACE FITTINGS

[75] Inventors: John Egenolf, Shotley Bridge; Stephen John Osborne, Richmond, both of England

[73] Assignee: Advanced Materials Engineering Limited, Gateshead, England

[22] Filed: Dec. 2, 1974

[21] Appl. No.: 528,978

[52] U.S. Cl. ..... 432/258; 432/259; 32/1; 264/57

[51] Int. Cl.[2] ..... F27B 21/00

[58] Field of Search ..... 432/258, 259, 253; 264/57–59; 32/1

[56] References Cited

UNITED STATES PATENTS

| | | | |
|---|---|---|---|
| 1,680,312 | 8/1928 | Whiteley, Jr. | 264/59 |
| 1,762,001 | 6/1930 | Turk | 432/259 |
| 1,941,941 | 1/1934 | Irwin | 432/259 |
| 2,173,107 | 9/1939 | Gould | 264/58 |
| 2,208,734 | 7/1940 | Schreiber | 432/259 |
| 2,273,475 | 2/1942 | Schrieber | 432/259 |
| 2,867,888 | 1/1959 | Schaefer et al. | 432/259 |
| 2,881,502 | 4/1959 | Dopera | 432/259 |
| 3,137,910 | 6/1964 | Cummings | 432/259 |
| 3,861,867 | 1/1975 | Ouhl | 432/259 |
| 3,887,412 | 6/1975 | Styhr et al. | 264/58 |

FOREIGN PATENTS OR APPLICATIONS

| | | | |
|---|---|---|---|
| 486,330 | 6/1938 | United Kingdom | 432/259 |
| 143,345 | 12/1953 | Sweden | 432/259 |
| 464,708 | 8/1928 | Germany | 432/259 |

*Primary Examiner*—John J. Camby
*Assistant Examiner*—Henry C. Yuen

[57] ABSTRACT

The invention is furnace fittings in which supports made of silicon nitride or of other ceramic are formed so as to be removably fitted to a base, the supports being formed also so as to support a "green" artefact such as dental artefacts during firing of the green artefact in a furnace.

4 Claims, 4 Drawing Figures

FURNACE FITTINGS

BACKGROUND OF THE INVENTION

The invention relates to furnace fittings for use in supporting green artefacts during firing. For example, the green artefacts may be dental artefacts and the fittings may be capable of arrangement in various patterns to support different shapes of artefact.

Furnace fittngs are known for such work but suffer from the disadvantage that they cannot be re-arranged for different uses and the known supports are generally unfit for further use after one or perhaps two periods of furnace surface.

The present invention provides furnace fittings which are very adaptable and which can be re-used many times.

BRIEF DESCRIPTION OF THE INVENTION

Furnace fittings in accordance with the invention comprise in combination a base and support means selectively arrangeable on the base, the base and the support means comprising recess means and projection means which are releasably inter-engageable and the base and the support means being made of ceramic material.

Preferably, the support means comprises peg-like means including a lower spigot projection means and an upper head means.

DESCRIPTION OF THE PREFERRED EMBODIMENTS

Figure 1:
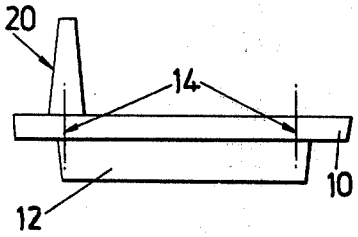
FIG. 1 is an elevation of a base and support means supported thereon.
Figure 2:
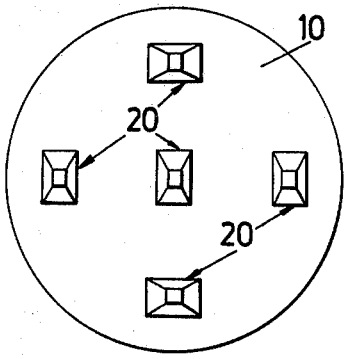
FIG. 2 is a plan of the base and support means shown in FIG. 1.
Figure 3:
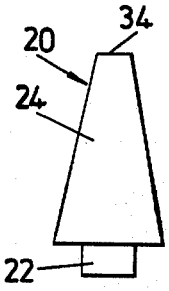
FIG. 3 is an enlarged elevation of a single support means.
Figure 4:
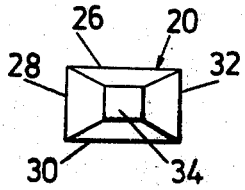
FIG. 4 is an enlarged plan of the support means shown in FIG. 3.

The drawings show a base in the form of a circular plate 10 having circular spigot 12 of slightly tapered form extending from the underside of the plate 10. The plate 10 has five circular blind holes open at the upper face of the plate 10 and indicated at 14. Each hole 14 is adapted to receive a support 20 each in the form of a cylindrical short stem 22 surmounted by a tapered head 24. The short stem 22 is of a size to fit closely in a hole 14.

The head 24 has four inclined flat faces 26, 28, 30, 32 which converge and terminate at a plain rectangular end face 34.

The supports 20 are readily removable from the plate 10 and replaceable by other supports of different shape. Alternatively some only of the supports may be removed so that a different pattern of supports remains.

The plate 10 and supports 20 are all made of silicon nitride.

Many further variations are possible within the scope of the invention. For example, a support may be so shaped as to present alternative support faces or shapes by re-positioning the support in or on the same formation or in or on an alternative formation of the base.

The angular orientation of a support may similarly be altered by re-positioning the support in or on the same formation or in or on an alternative formation of the base.

A support may be a simple peg-like member or may be curved, cranked, double-legged, multi-legged, single or multi-headed. Where it is double or multi-legged the support can be engageable with two or more formations on the base.

Supports may be shaped so as to cooperate one with another where required.

The separability of the support(s) and the base means means that supports are readily replaceable for any purpose including replacement of damaged or mislaid supports. Also, the manufacture of the supports themselves, typically as silicon nitride artefacts, can be sophisticated so as to make available a very wide range of support shapes and to ensure very high accuracy.

The invention is applicable outside the field of dental ceramics, for example it is applicable in the field of jewelry manufacture.

The base and the supports are made of a material which, so far as possible, is not wet by the material of the "green" artefact supported by the support. In the case of green dental artefacts an ideal material for both the base and the supports is silicon nitride. Silicon nitride remains clean and stands up excellently to the conditions in the furnace during firing of the green artefact. Damage to the supports is minimal and they are readily re-usable many times.

What we claim is:

1. Furnace fittings for furnace firing green ceramic artefacts comprising:

a. a support base having plural mounting means, b. and a plurality of artefact supporting means each having mounting means removably engaged with one of said base mounting means to removably mount said artefact supporting means on said base, c. said support base and each of said artefact supporting means consisting of silicon nitride and being directly engageable with said green ceramic artefact without wetting of the silicon nitride by the heated green ceramic.

2. Furnace fittings as claimed in claim 1 wherein each artefact supporting means comprises an elongated member having a lower projecting means and an upper head means, said support base having recesses for removably receiving the lower projecting means of the artefact supporting means.

3. Furnace fittings are claimed in claim 1 wherein the green ceramic artefacts are porcelain dental appliances.

4. Furnace fittings as claimed in claim 2, in which said head means is tapered and comprises four converging plain surfaces terminating in a plain rectangular surface at a free extremity of said head means.

* * * * *